United States Patent [19]

Kimmel et al.

[11] 4,053,668

[45] Oct. 11, 1977

[54] TUFTED CARPENTING WITH UNITARY NEEDLEBONDED BACKING AND METHOD OF MANUFACTURING THE SAME

[75] Inventors: Richard Kimmel, Lake Forest; Robert C. Pickens, Jr., Wildwood, both of Ill.

[73] Assignee: Brunswick Corporation, Skokie, Ill.

[21] Appl. No.: 686,479

[22] Filed: May 14, 1976

Related U.S. Application Data

[63] Continuation of Ser. No. 494,797, Aug. 5, 1974, abandoned.

[51] Int. Cl.[2] ..... B32B 33/00

[52] U.S. Cl. ..... 428/95; 28/107; 112/410; 112/420; 156/72; 428/234; 428/235; 428/300

[58] Field of Search ..... 428/235; 428/95, 234, 300; 156/72; 28/72.2 R; 112/410, 420

[56] References Cited

U.S. PATENT DOCUMENTS

| | | | |
|---|---|---|---|
| 2,706,324 | 4/1955 | Cogovan | 428/95 |
| 3,535,192 | 10/1970 | Gamble | 428/95 |
| 3,542,632 | 11/1970 | Eickhoff | 428/95 |
| 3,605,666 | 9/1971 | Kimmel | 428/95 |
| 3,817,817 | 6/1974 | Pickens | 428/95 |
| 3,861,992 | 1/1975 | DeNobriga | 428/234 |

FOREIGN PATENT DOCUMENTS

| | | | |
|---|---|---|---|
| 1,068,432 | 5/1967 | United Kingdom | 428/95 |
| 1,249,756 | 10/1971 | United Kingdom | 428/95 |

*Primary Examiner*—Marion E. McCamish
*Attorney, Agent, or Firm*—J. G. Heimovics; D. S. Guttman; S. L. Epstein

[57] ABSTRACT

Tufted carpeting has a unitary primary backing comprising a woven synthetic scrim with a backing layer of staple fibers needled onto its back surface before tufting. The tuft bases are at least partially surrounded by the fibers of the backing layer, and sizing is applied to the underside of the carpet after tufting. The resulting product has excellent dimensional stability, stiffness and flame retardance, and requires no secondary backing. In the preferred embodiment, the staple fibers are needled through the scrim to provide, in addition to the backing layer, a dyeable subface on the face side.

4 Claims, 5 Drawing Figures

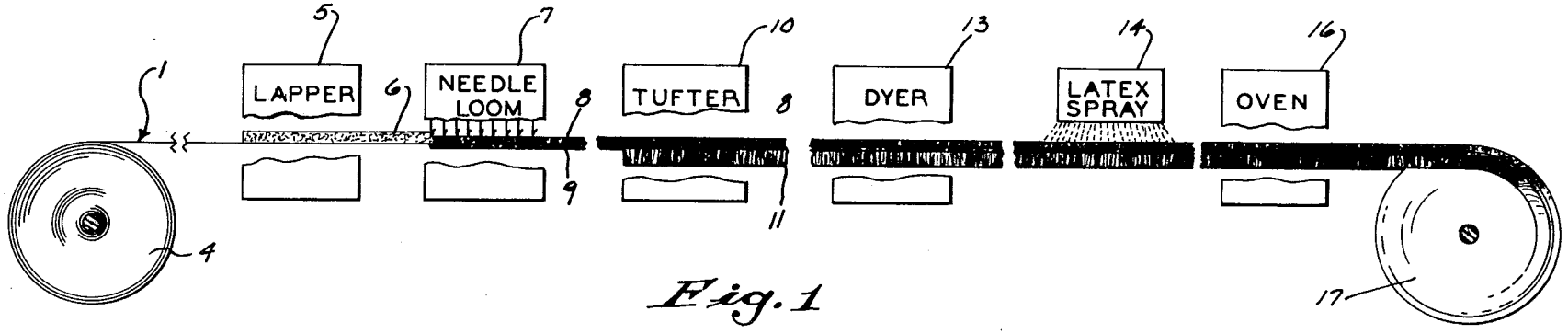
Fig. 1
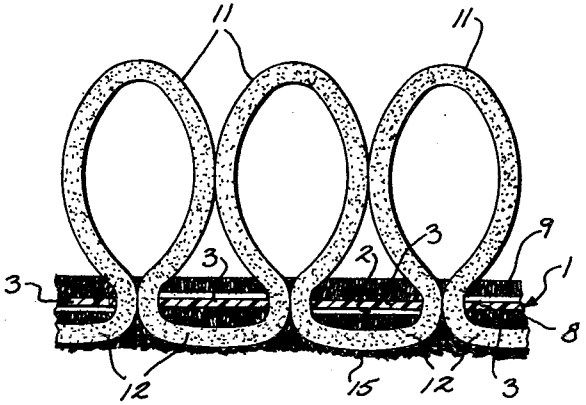
Fig. 4
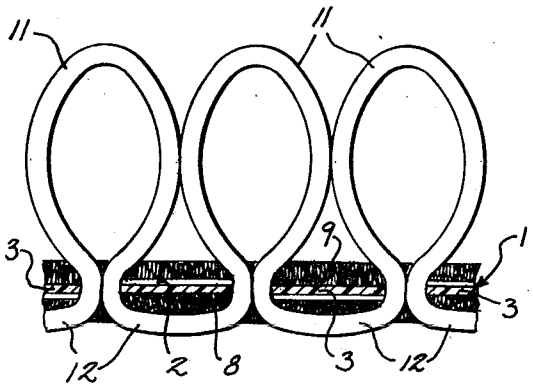
Fig. 3
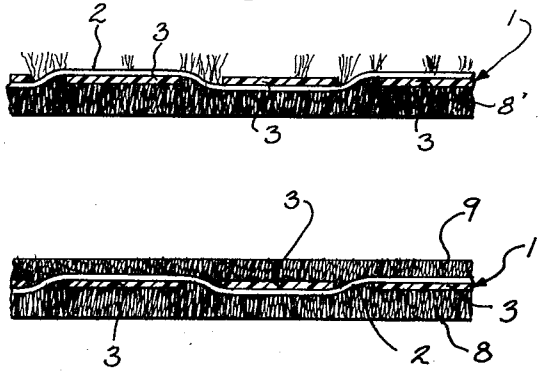
Fig. 2
Fig. 5

TUFTED CARPENTING WITH UNITARY NEEDLEBONDED BACKING AND METHOD OF MANUFACTURING THE SAME

REFERENCE TO EARLIER APPLICATION

This application is a continuation of application Ser. No. 494,797 filed Aug. 5, 1974, now abandoned.

BACKGROUND OF THE INVENTION

Woven synthetic scrims are now widely used as the primary backing material for tufted carpeting, and scrims woven from polypropylene ribbon filaments are probably the most common. While such scrims have a number of desirable characteristics, they also present some problems. The finished product may not, for example, have suficient dimensional stability, it may not have desirable stiffness, or it may not meet current standards for flame retardance. Another problem is that woven synthetic scrims can be difficult to tuft through because the scrim filaments are likely to slide over one another during the tufting process.

To provide the desired dimensional stability and stiffness for products of the type contemplated, it is common to provide a secondary backing such as jute or a foam layer, but this presents several disadvantages. First, the use of a secondary backing obviously increases material and manufacturing costs. Further, conventional secondary backings reduce the porosity of the finished product so that it holds more liquid and is, for example, less desirable for outdoor use. Still further, conventional secondary backings tend to reduce the flame retardance of the finished product, at least as measured by tunnel test.

non-woven staple fibers have been used with synthetic scrims, or to form primary backing materials, but have not heretofore been used in the way contemplated by this invention. In U.S. Pat. No. 3,605,666, dated Sept. 20, 1971, for example, a relatively thin non-woven layer is applied to the top of a woven synthetic scrim; but it serves primarily an esthetic function by providing a dyeable subface. In U.S. Pat. 3,817,817, dated June 18, 1974, a needlebonded layer is applied to the underside of a woven synthetic scrim to make a secondary backing material. In U.S. Pat. No. 2,706,324, dated Apr. 19, 1955, staple fibers are needled onto the bottom surface of a tufted carpet after tufting. In U.S. Pat. Nos. 2,810,950, dated Oct. 29, 1957, and 2,866,206, dated Dec. 30, 1958, needled staple fibers are applied to a fabric, but the fabric appears to serve primarily as a carrier for the fibers, as opposed to providing substantial dimensional stability in its own right, so that the resulting product is essentially a non-woven backing.

SUMMARY OF THE INVENTION

This invention contemplates tufted carpeting comprising an improved, unitary primary backing having a woven synthetic scrim with a backing layer of staple fibers needled onto its back surface before tufting. Suitable yarn is then tufted through the backing, the bases of the tufts being at least partially surrounded by the backing layer, and latex or other sizing material is applied to the bottom surface after tufting. The backing is easy to tuft through, the finished product has excellent stability, stiffness and flame retardance, and no secondary backing is required. Material costs are relatively low, and the manufacturing process is relatively simple and inexpensive.

In the preferred embodiment, staple fibers are selected that can be dyed with the same dye system to be used for the tufts, and the fibers are needled through the scrim to also provide a dyeable subface on the face side, thus additionally affording the esthetic advantages referred to in the aforesaid U.S. Pat. No. 3,605,666 without great increases in manufacturing expense.

The foregoing are illustrative only, and additional features, objects and advantages will appear from the description to follow.

BRIEF DESCRIPTION OF THE DRAWING

FIG. 1 is a schematic representation of a manufacturing line for performing a preferred embodiment of the process and manufacturing a preferred embodiment of the product of the invention, FIG. 2 is an enlarged, somewhat schematic, fragmentary view in cross section showing a preferred embodiment of the unitary needle-bonded backing material of the invention, as manufactured in accordance with FIG. 1, before tufting.

FIG. 3 is a view similar to FIG. 2 but showing the product after tufting,

FIG. 4 is a view similar to FIGS. 2 and 3 but showing the material after dyeing and sizing, and FIG. 5 is a view similar to FIG. 2 but illustrating a different embodiment.

DESCRIPTION OF THE PREFERRED EMBODIMENT

The scrim used in the preferred embodiment is a generally conventional, woven polypropylene scrim with ribbon filaments. It is designated generally by the reference numeral 1; and as can be seen in FIGS. 2–4 it has warp ribbons 2 (only one of which can be seen) and weft or fill ribbons 3. The preferred scrim is a 30 × 11 construction — meaning that there are 30 warp ribbons and 11 fill ribbons to the inch — and weighs approximately 3.3 ounces per square yard. The warp ribbons are approximately 0.045 inches wide (which means that there is some overlapping and/or bending to have 30 filaments per inch) and 0.0022 inches thick; and the fill ribbons are about 0.09 inches wide and 0.0036 inches thick. While this construction is preferred, other scrim constructions can be substituted.

Referring now to FIG. 1, the scrim 1 is fed from a supply roll 4 to a conventional lapper 5 which deposits, on what will be the back or bottom surface, a layer 6 of garnetted staple fibers. The fibers are preferably nylon, 15–20 denier, 1.5–3 inches in length and are deposited at the rate of 5.5 ounces per square yard. As will be apparent to those skilled in the art, other fibers, fiber specifications, and application rates, methods and apparatus may be used.

The product then moves through a conventional needle loom 7 where the layer is needled through the scrim 1 to develop a backing layer 8 on the back surface and a subface 9 on the face side. As can be seen most clearly in FIG. 2, the backing layer 8 is relatively thicker, having a weight of approximately 3.5 ounces per square yard, and the subface 9 is relatively thinner, with the weight of about 2 ounces per square yard. The needle loom 7 preferably uses 15 × 18 × 20 × 3 dye pressed needles, 195 punches per square inch with a punching depth of 0.625 inches. All of these specifications can of course be varied to meet specific requirements, and for the preferred embodiment it would be possible to needle from either the top or bottom.

It is important to note that it is not necessary to needle the fibers through the scrim 1 to develop the subface 9. The same or a lesser or greater amount of fibers can simply be needled onto the bottom surface to develop a backing layer, and this construction is illustrated by FIG. 5 where the backing layer is identified by the reference numeral 8'. Needling onto the back surface only as illustrated by FIG. 5 will of course result in some fibers extending up through the scrim 1, as shown, but not enough to develop the visually continuous layer 9.

The backing as seen in FIG. 2, or as illustrated by FIG. 5, has a number of advantages over the woven scrim 1 itself. The layer 8, or 8', gives the backing significantly greater weight, stiffness and dimensional stability. The filaments 2 and 3 are held against relative sliding motion, and thus the backing is easier to tuft through. Further, the increased density and compaction provided by the fibers of the layer 8 or 8' gives the backing significantly improved flame retardance characteristics; flame retardance can be enhanced even more by using flame retardant fibers, such as wool, for the backing layer, but there is improvement even where less flame retardant fibers are used because of the compaction.

The backing then passes through a conventional tufter 10, where suitable yarn is tufted through from what will be the back side of the carpeting to provide tufts 11 which can be seen in FIGS. 3 and 4. The tufts 11 have bases 12 which are below the scrim 1 and partially surrounded by the fibers of the backing layer 8, the tufts 11 thus being held more securely in place than if the scrim 1 were used alone — in the terminology of the art, there is a better "tuft lock." The specifications for the product can be altered so that the degree to which the tuft bases 12 are surrounded by the fibers of the layer 8 is greater or less than that shown in FIGS. 3 and 4, but the tuft bases 12 should be surrounded at least partially to provide for the desired tuft lock.

In the preferred embodiment, nylon yarn is used for the tufting operation, but other materials could be used. Where there is a subface 9, the tuft material is preferably compatibly dyeable with the staple fibers — i.e. they are dyeable using the same dye system as set forth in the aforesaid U.S. Pat. No. 3,605,666 — but it would be possible to use pre-dyed staple fibers instead. The tufts can be looped as shown or cut, and may be of any suitable height and spacing.

After tufting, the material preferably passes through a suitable dyer 13, although dyeing can be accomplished after the sizing operation to be described, or may not be necessary at all to the extent that pre-dyed materials are used. Vat dyeing, printing, or other known methods can be used, and suitable ovens or other drying apparatus (not shown) can be used after the dyeing step. In the preferred embodiment, the staple fibers and tufts are dyed simultaneously by the same dye system, the subface 9 then serving to mask the scrim 1 and provide a more attractive appearance, again as set forth in the aforesaid U.S. Pat. No. 3,605,666. The resulting fiber and tuft coloration are indicated by stippling in FIG. 4, from which it can be seen that the dye preferably extends below the scrim 1 to color the tuft bases 12 and backing layer 8 as well as the tufts 11 and subface 9.

A suitable latex or other sizing is then applied to the back side of the carpeting, using a spray apparatus 14, or conventional roll coating or other suitable means. In the preferred embodiment, a carboxylated SBR (styrene butadiene rubber) based compound is used and it is applied at the rate of 3–30 ounces per square yard, depending on the method of application. As can be seen in FIG. 5, the sizing material, which is indicated by the reference numeral 15, is dispersed to some extent thoughout the backing layer 8, but is not above the scrim 1. The greatest concentration is on the bottom surface, but it is not necessary to use sufficient sizing material to develop an actual continuous skin on the back surface of the carpeting. After application, the sizing 15 is dried by passing the carpeting through a conventional oven 16, or drying can be accomplished using a can dryer or other suitable means. After drying, the product is complete and is wound on a storage roll 17.

The final carpeting, illustrated in FIG. 4, has excellent stiffness, dimensional stability and flame retardance, and it is unnecessary to provide a conventional secondary backing material such as jute or a layer of foam. The dyeable subface 9, if provided, gives the improved esthetic characteristics noted above. At the same time, the product and the process for manufacturing it are relatively simple and inexpensive.

While preferred embodiments of the invention have been shown and described, various changes in materials and specifications can be made as noted above or otherwise. The invention is not, therefore, intended to be limited by the showing or description herein, or in any other manner, except insofar as may specifically be required.

We claim:

1. A ribbon scrim tufted carpet having a unitary backing with two staple faces that does the job of both a primary backing and secondary backing, the carpet comprising:

a. a unitary backing with two staple faces having:
   1. a woven ribbon scrim with a first scrim side and a second scrim side, and
   2. a deposit layer of staple fibers needled through the scrim to form a bottom fiber layer on one of the scrim sides and a subface fiber layer on the other scrim side, the bottom fiber layer being thicker than the subface fiber layer; and b. yarn tufted through the unitary backing from the side having the bottom fiber layer to develop tufts, the tufts so developed:
   1. being partially surrounded by fibers of bottom fiber layer to provide better tuft lock, and
   2. extending above the subface fiber layer.

2. The carpet of claim 1 wherein:

the subface fiber layer is formed in sufficient density to develop a substantially visually continous mask of the ribbon scrim, and the staple fibers and tufting yarn are selected of materials that can be dyed with the same dye system;

whereby the simplified unitary backing of the carpet also provides for masking of the ribbon scrim by the subface fiber layer when the subface fiber layer and the tufting yarns are dyed to match each other.

3. A method of manufacturing ribbon scrim tufted carpeting using a unitary backing with two staple faces to do the job of both a primary backing and a secondary backing, the method comprising the steps of:

a. providing a unitary backing with two staple faces by steps comprising:
   1. providing a woven ribbon scrim having a first scrim side and a second scrim side, 2. depositing a deposit layer of staple fibers on the first scrim side, and
3. needling a portion of the deposit layer through the scrim to form a bottom fiber layer on one of the scrim sides and a subface fiber layer on the other scrim side, the bottom fiber layer being thicker than the subface fiber layer; and b. tufting yarn through the unitary backing from the side having the bottom fiber layer to develop tufts, the tufts so developed:
1. being partially surrounded by fibers of the bottom fiber layer to provide better tuft lock, and
2. extending above the subface fiber layer.

4. The method of claim 3 wherein step (a) (3) further includes the steps of:
forming the subface fiber layer in sufficient density to develop a substantially visually continous mask of the ribbon scrim, and
selecting the staple fibers and tufting yarn of materials that can be dyed using the same dye system;
whereby the steps that provide a simplified unitary backing also provide for masking of the ribbon scrim by the subface fiber layer when the subface fiber layer and the tufting yarns are dyed to match each other.

* * * * *